US005497222A

United States Patent [19]

Landa et al.

[11] Patent Number: 5,497,222

[45] Date of Patent: Mar. 5, 1996

[54] IMAGE TRANSFER APPARATUS INCORPORATING AN INTEGRAL HEATER

[75] Inventors: Benzion Landa, Edmonton, Canada; Hanna Pinhas, Holon; Paul Fenster, Petach Tikva, both of Israel

[73] Assignee: Indigo N.V., Veldhoven, Netherlands

[21] Appl. No.: 406,396

[22] Filed: Mar. 20, 1995

Related U.S. Application Data

[63] Continuation of Ser. No. 249,984, May 27, 1994, which is a continuation of Ser. No. 17,410, Feb. 11, 1993, Pat. No. 5,335,054, which is a continuation of Ser. No. 777,008, Oct. 16, 1991, abandoned, which is a continuation of Ser. No. 393,631, Aug. 14, 1989, Pat. No. 5,089,856, which is a continuation-in-part of Ser. No. 306,065, Feb. 6, 1989, Pat. No. 4,984,025.

[51] Int. Cl.[6] ..... G03G 15/12

[52] U.S. Cl. ..... 355/279; 355/277

[58] Field of Search ..... 355/271, 277, 355/279, 274, 273, 275, 290; 219/216, 469, 470, 471

[56] References Cited

U.S. PATENT DOCUMENTS

| | | | |
|---|---|---|---|
| 415,856 | 11/1889 | Carpenter . | |
| 3,624,353 | 11/1971 | Bjorklund . | |
| 3,657,103 | 4/1972 | Fisher et al. . | |
| 3,684,364 | 8/1972 | Schmidlin . | |
| 3,702,482 | 11/1972 | Dolcimascolo et al. . | |
| 3,741,643 | 6/1973 | Smith et al. . | |
| 3,767,300 | 10/1973 | Brown et al. . | |
| 3,832,055 | 8/1974 | Hamaker . | |
| 3,834,808 | 9/1974 | Takahashi et al. | 355/200 |
| 3,847,478 | 11/1974 | Young . | |
| 3,862,848 | 1/1975 | Marley . | |
| 3,863,603 | 2/1975 | Buckley et al. . | |
| 3,893,761 | 7/1975 | Buchan et al. . | |
| 3,900,003 | 8/1975 | Sato et al. . | |
| 3,955,533 | 5/1976 | Smith et al. . | |
| 3,959,574 | 5/1976 | Seanor et al. . | |
| 3,983,287 | 9/1976 | Goosen et al. . | |
| 4,039,257 | 8/1977 | Connolly . | |
| 4,286,039 | 8/1981 | Landa et al. . | |
| 4,325,627 | 4/1982 | Swidler et al. . | |
| 4,341,455 | 7/1982 | Fedder . | |
| 4,344,700 | 8/1982 | Kasama et al. | 355/211 |
| 4,348,098 | 9/1982 | Koizumu . | |
| 4,439,035 | 3/1984 | Landa . | |
| 4,453,820 | 6/1984 | Suzuki . | |
| 4,455,079 | 6/1984 | Miwa et al. . | |
| 4,460,667 | 7/1984 | Landa . | |
| 4,482,242 | 11/1984 | Moraw et al. . | |
| 4,518,976 | 5/1985 | Tarumi et al. . | |
| 4,531,825 | 7/1985 | Miwa et al. . | |
| 4,557,583 | 12/1985 | Percic et al. . | |
| 4,571,059 | 2/1986 | Huss . | |

(List continued on next page.)

FOREIGN PATENT DOCUMENTS

| | | |
|---|---|---|
| 0318078 | 5/1989 | European Pat. Off. . |
| 2250778 | 5/1973 | Germany . |
| 3816929 | 12/1988 | Germany . |
| 56-164368 | 12/1981 | Japan . |
| 58-044472 | 3/1983 | Japan . |

OTHER PUBLICATIONS

Web Offset Press Operating (Second Edition) by David B. Crouse, Edward J. Kelly and Robert Supansic.

*Primary Examiner*—A. T. Grimley
*Assistant Examiner*—T. A. Dang
*Attorney, Agent, or Firm*—Sandler, Greenblum & Bernstein

[57] ABSTRACT

An imaging system including an image bearing surface and an intermediate transfer member operative for transfer of toner images from the image bearing surface to a transfer surface of the intermediate transfer member and for subsequent transfer to a substrate.

The intermediate transfer member includes a compressible layer, a backing layer disposed away from said image bearing surface and a heating layer. The heating layer is disposed intermediate backing layer and said transfer surface.

22 Claims, 7 Drawing Sheets

U.S. PATENT DOCUMENTS 4,585,319 4/1986 Okamoto et al. .
4,588,279 5/1986 Fukuchi et al. .
4,588,319 5/1986 Neimeyer .
4,628,183 12/1986 Satomura .
4,684,238 8/1987 Till et al. .
4,690,539 9/1987 Radulski et al. .
4,708,460 11/1987 Langdon .
4,743,939 5/1988 Dulmage et al. .
4,788,572 11/1988 Slayton et al. .
4,791,275 12/1988 Lee et al. .
4,794,651 12/1988 Landa et al. .
4,796,048 1/1989 Bean .
4,864,367 9/1989 Nakahara et al. .
4,910,558 3/1990 Giezeman et al. .
4,912,514 3/1990 Mitzutani .
5,001,034 3/1991 Omote et al. .
5,108,865 4/1992 Zwaldo et al. .
5,132,743 7/1992 Bujese .
5,373,855 12/1993 Omote et al. .

FIG.3C
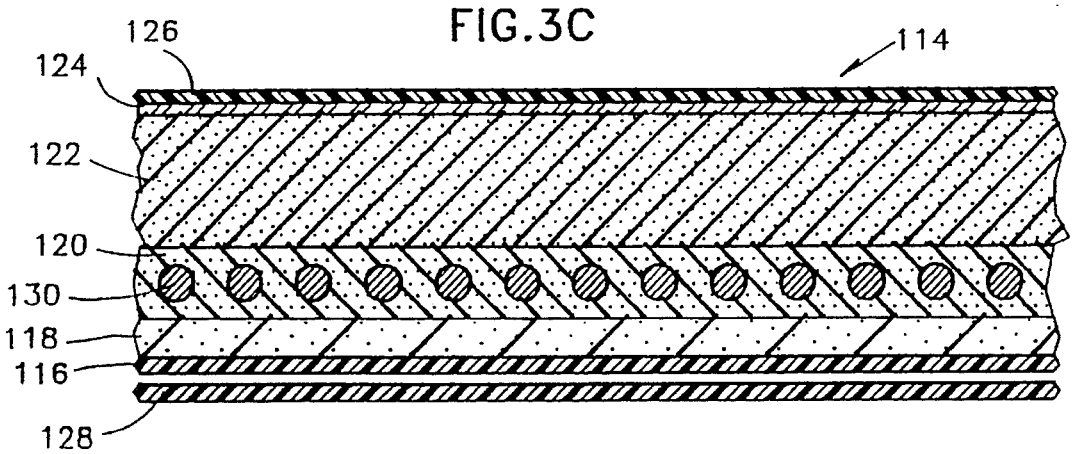
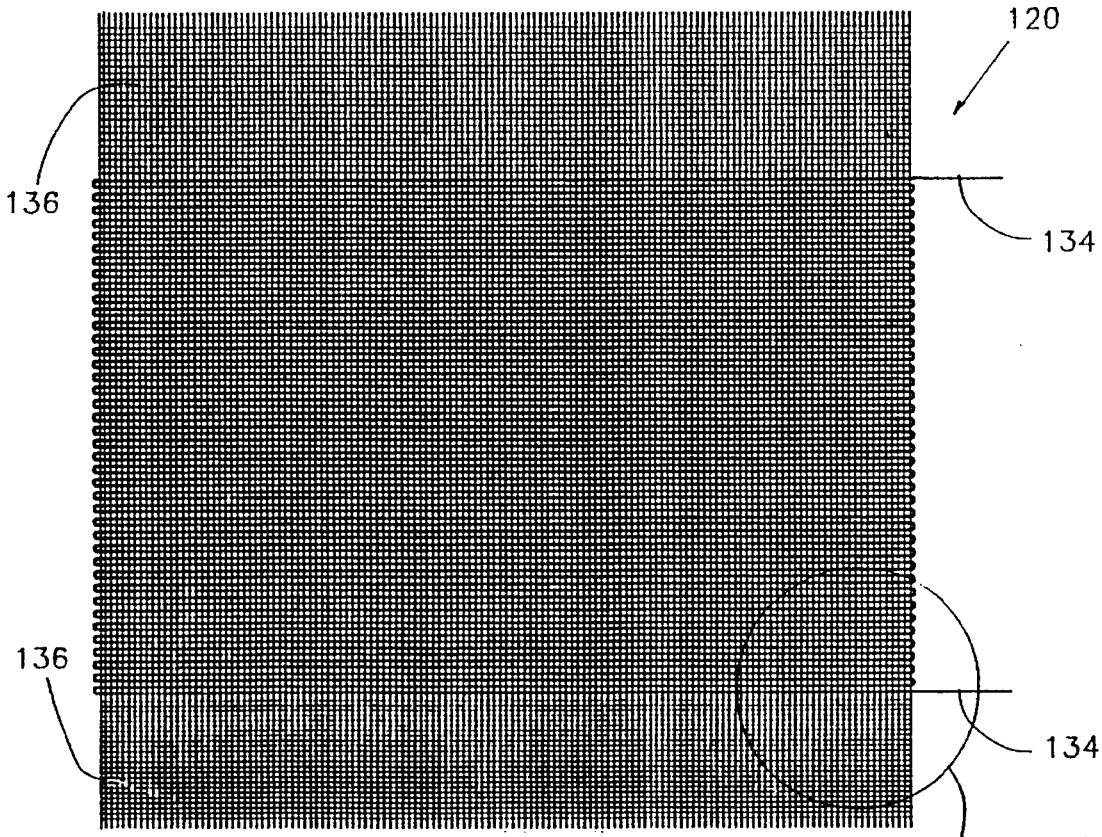
FIG.3D
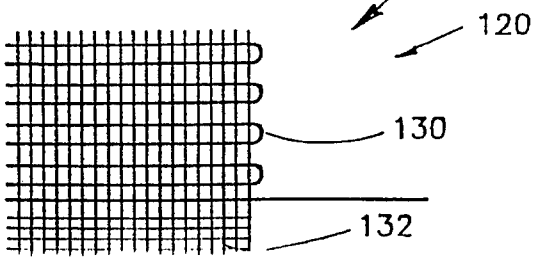
FIG.3E

IMAGE TRANSFER APPARATUS INCORPORATING AN INTEGRAL HEATER

This application is a continuation of application Ser. No. 08/249,984 filed May 27, 1994, which is a continuation of application Ser. No. 08/017,410 filed Feb. 11, 1993 (now U.S. Pat. No. 5,335,054 issued Aug. 2, 1994), which is a continuation of application Ser. No. 07/777,008 filed Oct. 16, 1991 (now abandoned), which is a continuation of application Ser. No. 07/393,631 filed Aug. 14, 1989 (now U.S. Pat. No. 5,089,856 issued Feb. 18, 1992), which is a continuation-in-part of application Ser. No. 07/306,065 filed Feb. 6, 1989 (now U.S. Pat. No. 4,984,025 issued Jan. 8, 1991).

FIELD OF THE INVENTION

The present invention relates to image transfer techniques and apparatus for use in liquid toner electrostatic imaging using an intermediate transfer member.

BACKGROUND OF THE INVENTION

The use of an intermediate transfer member in electrostatic imaging is well known in the art.

Various types of intermediate transfer members are known and are described, for example in U.S. Pat. Nos. 3,862,848, 4,684,238, 4,690,539 and 4,531,825.

Belt-type intermediate transfer members for use in electrophotography are known in the art and are described, inter alia, in U.S. Pat. Nos. 3,893,761, 4,684,238 and 4,690,539.

In both liquid and powder toner imaging systems employing intermediate transfer members it is known to heat the toner images on the intermediate transfer member before transfer to the final substrate. In U.S. Pat. No. 4,708,460 a liquid toner image is heated by radiant heat from a heater external to the transfer member in order to evaporate the liquid carrier and to melt the solid toner before transfer. In U.S. Pat. No. 4,518,976 there is described a belt image transfer system, wherein the belt is heated by a heating roller which is provided at the back of the belt during transfer from the belt to the final substrate. In U.S. Pat. No. 4,585,319 a radiant heater in the center of a drum ITM is used to heat the ITM.

The use of intermediate transfer members is well known in the printing art. In offset printing an image formed of a viscous ink is transferred from a drum to a second drum prior to transfer to the final substrate. It has been recognized that the pressures between the various drums and against the final substrate are important to the quality of the final print. Two types of offset blankets are generally available, consistent with the ink characteristics.

Conventional printing blankets are relatively stiff and have little leeway for packing error. Compressible blankets are made with varying compressibilities, with typical curves shown for example on page 33 of "Web Offset-Press Operating", published by Graphic Arts Technical Foundation, Pittsburgh, Pa., 1984.

The pressures used in offset printing are not generally measured, but it is believed that they are in the general vicinity of 100–150 lb./sq. in. as indicated in the above reference and in U.S. Pat. No. 3,983,287.

SUMMARY OF THE INVENTION

The present invention seeks to provide apparatus and techniques for improved electrostatic image transfer using an intermediate transfer member.

There is therefore provided an imaging system including, an image bearing surface, an intermediate transfer member operative for transfer of toner images from the image bearing surface to a transfer surface of the intermediate transfer member and for subsequent transfer to a substrate, the transfer member including a compressible layer, a backing layer disposed away from the transfer surface, and a heating layer disposed intermediate the backing layer and the transfer surface.

In a preferred embodiment of the invention the heating layer is disposed intermediate the compressible layer and the transfer surface.

In a preferred embodiment of the invention the heating layer is disposed intermediate the compressible layer and the backing layer.

The transfer member further comprises, in a preferred embodiment of the invention, a second compressible layer, and the heating layer is disposed intermediate the compressible layer and the second compressible layer.

There is further provided in a preferred embodiment of the invention an imaging system including: an image bearing surface, an intermediate transfer member operative for transfer of liquid toner images from the image bearing surface to a substrate wherein the transfer member includes at least one compressible layer including a heating layer and a backing layer disposed away from the image bearing surface.

In a preferred embodiment of the invention the heating layer is internal to the at least one compressible layer.

In a preferred embodiment of the invention the intermediate transfer member includes a conductive layer operative to apply an electric field to the image to enhance transfer of toner images from the image bearing surface to the intermediate transfer member.

The heating layer is operative in a preferred embodiment of the invention to heat the image to a temperature sufficient to enhance transfer of toner images from the intermediate transfer member to the substrate.

According to a preferred embodiment of the invention the apparatus also includes apparatus for providing first transfer engagement between the intermediate transfer member and the image bearing surface for transfer of an image from the image bearing surface to the intermediate transfer member at a first pressure and apparatus for providing second transfer engagement between the intermediate transfer member and the substrate for transfer of the image from the intermediate transfer member to the substrate at a second pressure, wherein the pressure is substantially constant along particular lines upon the first and second transfer engagements on the intermediate transfer member, and wherein the heating layer is formed of thin wires along the lines.

There is provided in a further embodiment of the invention an intermediate transfer blanket for the transfer of toner images from a first surface to a second surface and including a transfer surface for operative engagement with the first and second surfaces, a relatively compliant sponge layer, and an area heater placed between the relatively compliant sponge layer and the transfer surface.

In a preferred embodiment of the invention the blanket also includes a relatively less compliant resilient layer placed between the heater and the transfer surface.

In a preferred embodiment of the invention the toner image is a liquid toner image.

In a preferred embodiment of the invention the heater is energized by alternating current and the thin wires are arranged in adjoining pairs, the voltage on each wire of the pair being equal and of opposite sign to that of the other with respect to a reference voltage. In a preferred embodiment of the invention the reference voltage is ground.

BRIEF DESCRIPTION OF THE DRAWINGS

The present invention will be understood and appreciated more fully from the following detailed description, taken in conjunction with the drawings in which:

FIG. 3C is a simplified, conceptual, sectional illustration of a portion of a second preferred embodiment of the intermediate transfer member of FIG. 3A;

FIG. 3D is an illustration of a preferred heater for the intermediate transfer member;

FIG. 3E is a detailed illustration of a portion of the embodiment of FIG. 3D;

DETAILED DESCRIPTION OF PREFERRED EMBODIMENTS

Figure 1:
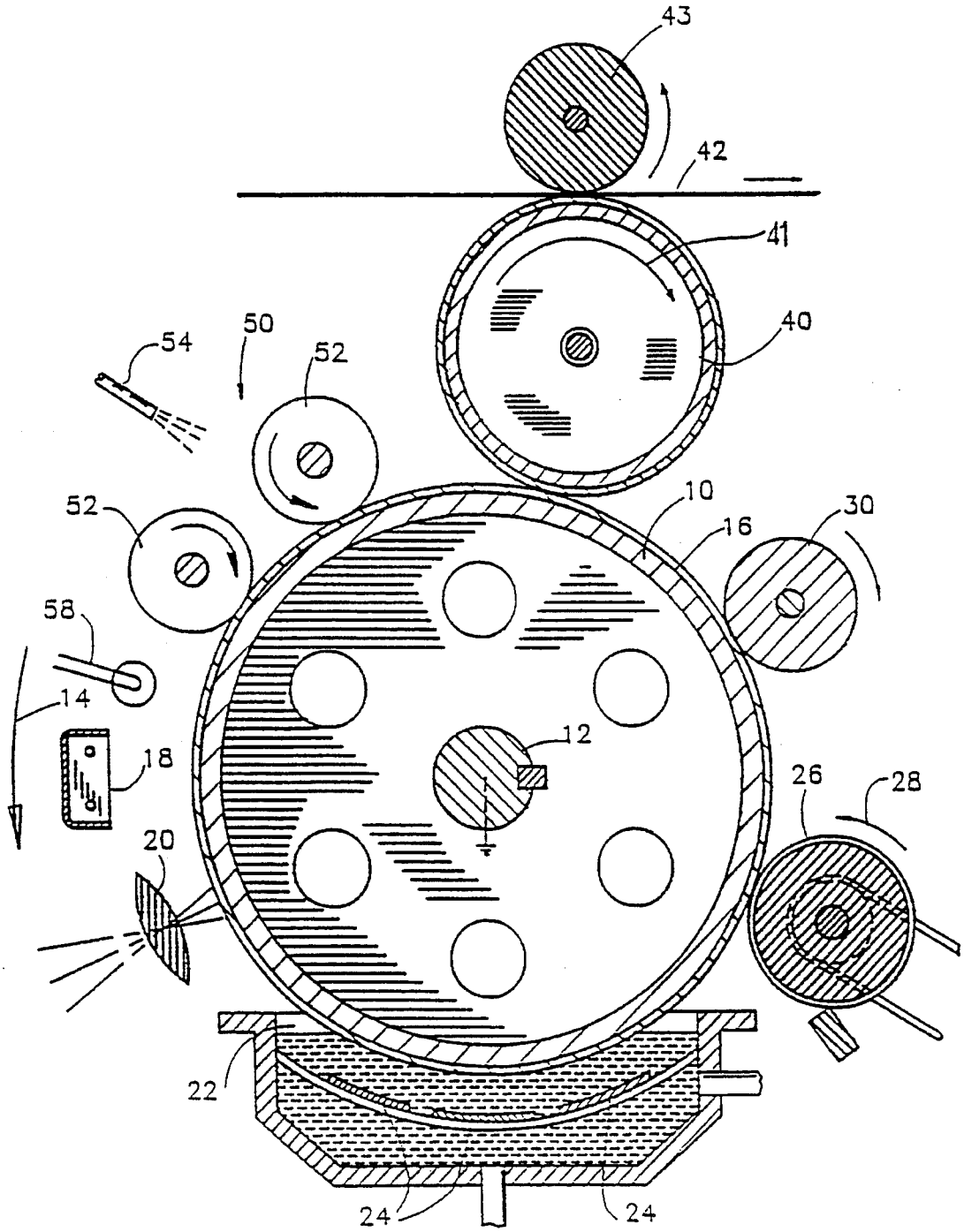
FIG. 1 is a simplified sectional illustration of electrostatic imaging apparatus constructed and operative in accordance with a preferred embodiment of the present invention.

Reference is now made to FIG. 1, which illustrates electrostatic imaging apparatus constructed and operative in accordance with a preferred embodiment of the present invention. This and other embodiments of the invention are described for apparatus utilizing liquid toner with negatively charged toner particles, and for a write-white system. For positively charged toner particles and/or for a write-black system the magnitudes and or the polarities of the voltages are adjusted as is well known in the art. In a preferred embodiment of the invention the toner of Example 1 of U.S. Pat. No. 4,794,651 which is incorporated herein by reference, is employed, but a variety of liquid toner types are useful in the practice of the invention.

As in conventional electrophotographic systems, the apparatus of FIG. 1 comprises a drum 10 arranged for rotation about an axle 12 in a direction generally indicated by arrow 14. The drum 10 is formed with a cylindrical photoconductive surface 16.

A corona discharge device 18 is operative to generally uniformly charge the photoconductor surface 16 with a positive charge. Continued rotation of the drum 10 brings the charged photoconductor surface 16 into image receiving relationship with an exposure unit including a lens 20, which focuses a desired image onto the charged photoconductive surface 16, selectively discharging the photoconductive surface, thus producing an electrostatic latent image thereon. Lens 20 may be the lens of a photocopier, as illustrated, or alternatively, for example, the lens of a laser printer.

Continued rotation of the drum 10 brings the charged photoconductive surface 16 bearing the electrostatic latent image into a development unit 22, including development electrodes 24, which is operative to apply a liquid developer comprising carrier liquid and toner particles to develop the electrostatic latent image.

In accordance with a preferred embodiment of the invention, following application of toner thereto, the photoconductive surface 16 passes a, typically positively charged, rotating roller 26, preferably rotating in a direction indicated by an arrow 28. Typically the spatial separation of the roller 26 from the photoconductor surface 16 is about 50 microns.

Preferably, the voltage on roller 26 is intermediate the voltages of the latent image areas and of the background areas on the photoconductive surface 16. Typical voltages are: roller 26: +300 to +500 V, background area: +50 V and latent image areas: up to +1000 V.

It is appreciated that roller 26, rotating in the direction indicated by arrow 28, functions as a metering roller and reduces the thickness of liquid carrier on the photoconductive surface 16, as is known in the art.

In any event, the photoconductive surface 16, after passing the roller 26, should be relatively free of pigmented toner particles except in the region of the latent image.

Downstream of roller 26 there is preferably provided a rigidizing roller 30. The rigidizing roller 30 is preferably formed of a resilient polymeric material, such as conductive resilient polymeric materials as described in either or both of U.S. Pat. Nos. 3,959,574 and 3,863,603 and is preferably maintained in contacting or pressured relationship with the photoconductive surface 16.

In a preferred embodiment of the invention, the biased squeegee described in U.S. Pat. No. 4,286,039, the disclosure of which is incorporated herein by reference, is used as the roller 30. A negative voltage of about 1000 to 2000 Volts, preferably about 1500 Volts (for a write-white system), can be maintained on the squeegee. A corona discharge takes place and a current of approximately 50–100 microamperes for a drum width of 30 cm, flows from the squeegee. Roller 30 repels negatively charged pigmented toner particles and causes them to more closely approach the image areas of the photoconductive surface 16, thus compressing and rigidizing the toner image thereon.

Downstream of rigidizing roller 30 there is provided an intermediate transfer member 40, which rotates, as shown by arrow 41, in a sense opposite to that of drum 10, and is operative for receiving the toner image from surface 16 and for transferring the toner image to a receiving substrate 42, such as paper, which is supported by a roller 43.

The thrust of one aspect of the present invention lies in the structure and operation of the intermediate transfer member 40. Accordingly, in accordance with a preferred embodiment of the invention the intermediate transfer member 40 is configured and mounted with respect to the drum 10 for providing first transfer engagement between the intermediate transfer member 40 and the image bearing photoconductor surface 16 for transfer of an image from surface 16 to the intermediate transfer member 40 at a first pressure, producing radial deformation of the intermediate transfer member to a first deformation degree.

The configuration and arrangement of the intermediate transfer member 40, substrate 42 and roller 43 is preferably such as to provide second transfer engagement between the intermediate transfer member 40 and the substrate 42 for transfer of the image from the intermediate transfer member 40 to the substrate 42 at a second pressure, which exceeds the first pressure by a first multiple, producing radial deformation of the intermediate transfer member to a second deformation degree which exceeds the first deformation degree by a second multiple substantially less than the first multiple.

Additionally in accordance with a preferred embodiment of the present invention there is provided an intermediate transfer member characterized in that deformation thereof increases less than linearly with the application of increased pressure thereto. The structure of intermediate transfer members in accordance with the invention is described hereinbelow in detail.

Transfer of the image to intermediate transfer member 40 is preferably aided by providing electrification of the intermediate transfer member 40 to a voltage opposite that of the charged particles, although other methods known in the art may be employed. Subsequent transfer of the image to substrate 42 is preferably aided by heat and pressure, although other methods known in the art may be employed.

It has been noted that when the negatively biased squeegee roller of U.S. Pat. No. 4,286,039, with high negative voltage, is utilized as the roller 30, the positive voltage on the intermediate transfer member required to transfer the image thereto is sharply reduced, typically from about 1000 volts or more to about 500 to 600 volts or less. It is believed that this reduction is possibly due to a discharge of the charges in the image area of the photoconductive surface 16 by current from the squeegee roller.

Following transfer of the toner image to the intermediate transfer member, the photoconductive surface 16 is engaged by a cleaning roller assembly 50, including a pair of rollers 52, which typically rotate in opposite directions, and a nozzle 54. The cleaning roller assembly 50 is operative to scrub clean the surface 16. A cleaning material, such as liquid developer, may be supplied to the assembly 50 via nozzle 54. A suitable cleaning assembly is illustrated, in U.S. Pat. No. 4,439,035, the specification of which is incorporated herein by reference. Any residual charge left on the photoconductive surface 16 is removed by flooding the photoconductive surface 16 with light from a lamp 58.

Figure 2:
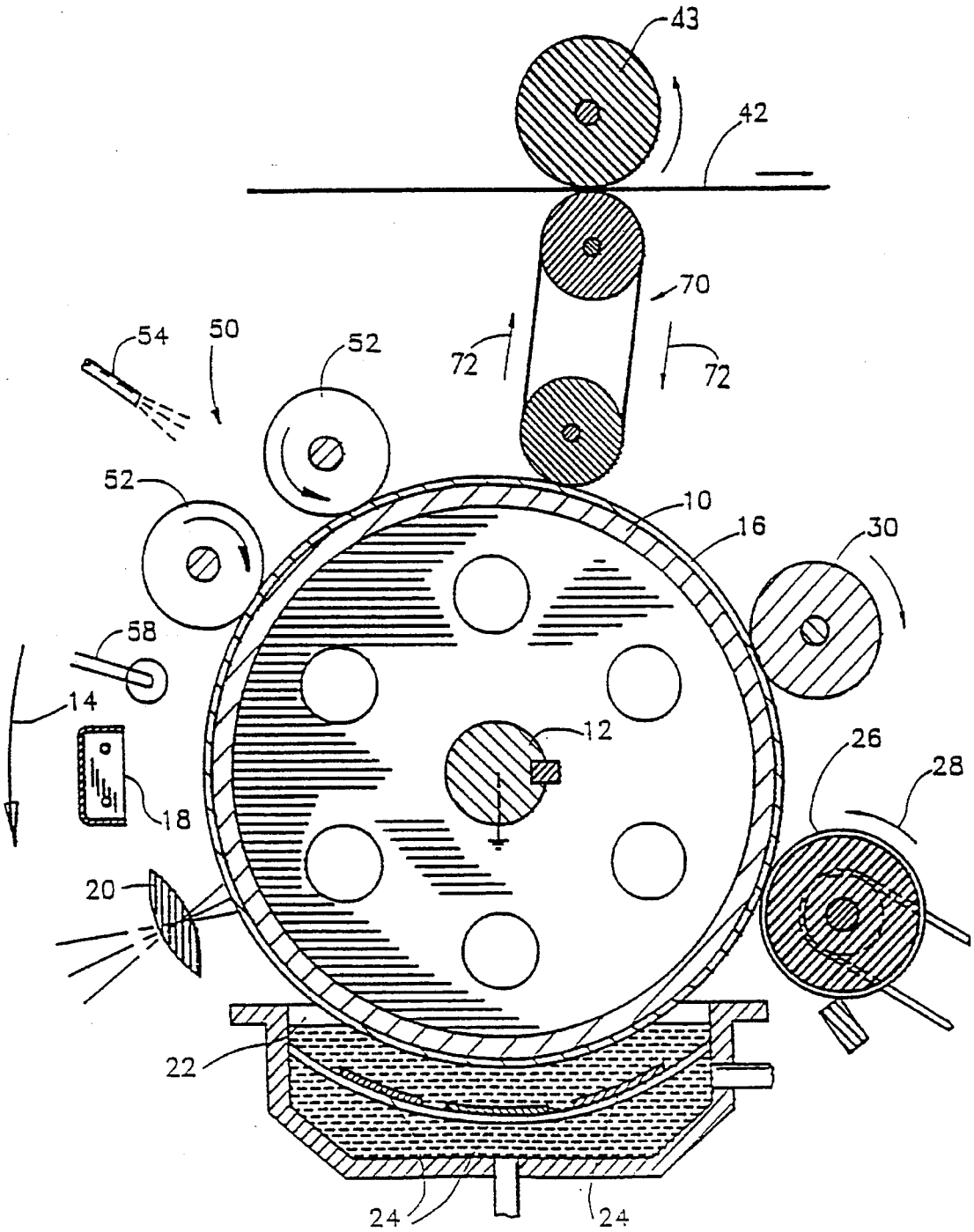
FIG. 2 is a simplified sectional illustration of electrostatic imaging apparatus constructed and operative in accordance with another preferred embodiment of the present invention.

Reference is now made to FIG. 2 which illustrates electrophotographic imaging apparatus constructed and operative in accordance with another preferred embodiment of the present invention. The apparatus of FIG. 2 shares many common elements with that of FIG. 1. These elements are indicated by identical reference numerals, and for the sake of conciseness are not described herein a second time.

The embodiment of FIG. 2 differs from that of FIG. 1 in that a belt-type intermediate transfer member 70 is employed instead of a roller type as in the embodiment of FIG. 1. Belt-type intermediate transfer members are well known in the art and are described, inter alia, in U.S. Pat. Nos. 3,893,761, 4,684,238 and 4,690,539, the disclosures of which are incorporated herein by reference.

Intermediate transfer member 70 is preferably charged so as to provide electrophoretic transfer of the image from the photoconductive surface 16 thereto. Within given limits, the efficiency of electrophoretic transfer of the image can be enhanced by increasing the potential difference between the photoconductive surface 16 and the intermediate transfer member 70. Increase in the potential difference between the photoconductive surface 16 and the intermediate transfer member 70 is limited, however, by the danger of severe electrical breakdown, which increases with an increase in potential difference.

Figure 3A:
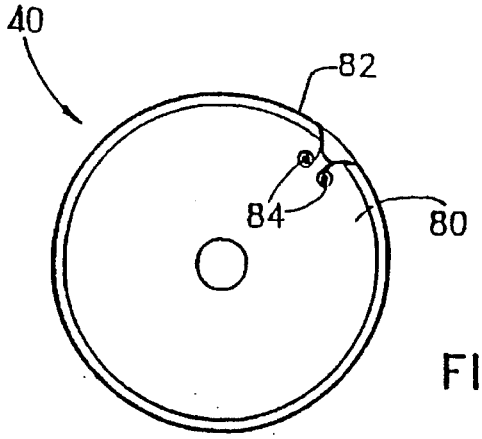
FIG. 3A is a simplified, conceptual, sectional illustration of intermediate transfer member constructed and operative in accordance with a preferred embodiment of the present invention.

Reference is now made to FIG. 3A which conceptually illustrates an intermediate transfer member 40 comprising a drum 80 having a generally cylindrical surface over which is tensioned a multi-layer intermediate transfer blanket 82, which is supported and tensioned by a blanket lockup mechanism 84. The electrical connections to the various voltage bearing portions of intermediate transfer blanket 82 are not shown, it being understood that they are achieved in a conventional manner using rotating contacts.

Figure 3B:
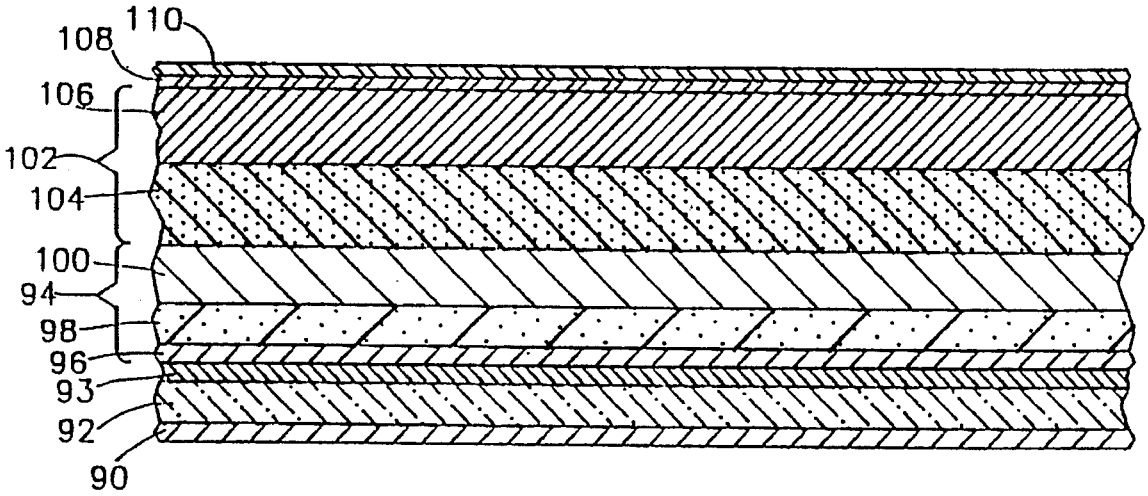
FIG. 3B is a simplified, conceptual, sectional illustration of a portion of a preferred embodiment of the intermediate transfer member of FIG. 3A.

A preferred embodiment of multi-layer intermediate transfer blanket 82 is illustrated in FIG. 3B and comprises a substrate (backing layer) 90 with high temperature capabilities, preferably formed of Kapton (DuPont) polyimide film of thickness about 100 microns. Over the substrate 90 there is provided a blanket heater 92 preferably comprising a meandering ribbon conductor of Nichrome in a sandwich of Kapton. Blanket heater 92 has a total thickness of about 250 microns.

Normally one surface of blanket heater 92 has a slightly raised pattern due to the presence of the ribbon. Accordingly, it is preferable to arrange the blanket heater 92 such that the surface having the slightly raised pattern lies facing substrate 90, such that the opposite facing surface of blanket heater 92 is relatively smooth.

Blanket heater 92, in conjunction with the rest of the intermediate transfer blanket 82 operates to improve transfer of the image to the final substrate by heating the toner image. When a liquid toner for which the particles solvate the carrier at a temperature below the melting point of the toner particles is utilized in the practice of the invention, then the surface of the blanket should be heated to a temperature above the solvation temperature of the toner image, i.e. above the temperature at which the toner particles become tacky to the final substrate. For the preferred toner of example 1 of U.S. Pat. No. 4,794,651, preferably the blanket heater is operative to heat the image on the intermediate transfer member to about 100°–110° C.

To ensure even heating, the top of the blanket heater 92 is attached to a 100 micron thick aluminum foil 93. This foil also provides electromagnetic shielding of the image transfer regions of the imaging apparatus from interference produced by AC currents used to heat the blanket 92. The width of the Nichrome ribbon is chosen such that the ribbon covers a major portion, preferably over 80% of the blanket, to ensure even heating thereof.

Disposed over foil 93 is a three part sponge assembly layer 94, including a layer 96 of Kapton, typically of thickness 100 microns, a sponge layer 98, typically of thickness 300 microns and a fabric layer 100, typically formed of NOMEX (DuPont) and being typically of thickness 350 microns. The total sponge assembly layer thickness is typically 800 microns. Nomex is basically an aromatic polyamide and chars at 420° C.

The assembly layer 94 is preferably formed by blending the following materials, which form the sponge layer 98, in a two roll mill:

| | |
|---|---|
| a. Fluorosilicone (FSE-2080 General Electric) | 78.39% |
| b. Silicone (Silastic 4-2735 Dow Corning) | 11.71% |
| c. Blowing Agent (#9038 Rhone Poulanc) | 9% |
| d. Cross-Linker (Di Cumyl Peroxide) | 0.9% |

Figure 4:
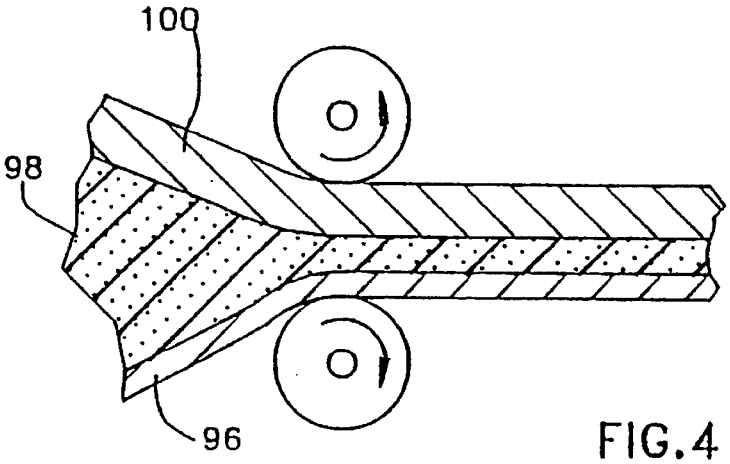
FIG. 4 is a simplified sectional illustration of the manufacture of part of the apparatus of FIGS. 3A and 3B.

The blended material is formed into the assembly layer 94 by calendering between the fabric layer 100 and the Kapton layer 96 as illustrated in FIG. 4.

The total thickness of assembly layer 94 is typically about 670 microns after calendering. The assembly layer 94 is then preferably cured for 10 minutes under nitrogen at 170° C. and preferably in a jig to control the total swelling thereof to a total thickness of about 800 microns. After the curing, the assembly layer 94 undergoes a post-cure at 200° C. for four hours.

It is a particular feature of the present invention that the sponge assembly layer 94 allows conformity between surface 16 and intermediate transfer member 40 at the first transfer at a relatively low pressure, such as 100–500 gm/cm$^2$ at a temperature of about 100°–110° C., with relatively low deformation, such as 30–200 microns, overcoming any surface unevenness of the mating surfaces.

According to the present invention, the sponge assembly layer 94 is further characterized in that it undergoes relatively high pressure, such as 2000–4000 gm/cm$^2$ at the second transfer with proportionately low deformation, greater then that at first transfer, preferably about 250 microns.

It is believed, that when the voltage on the rigidizing roller 30 is high enough to cause substantial compression of the image, generally at a value which also causes corona, the pressure at the first transfer surface can be increased up to about 500 gm/cm$^2$, without image degradation.

Returning now to the structure of the intermediate transfer blanket 82, it is seen that over sponge assembly layer 94, there is provided a blanket 102, typically of about 1200 microns thickness.

Blanket 102 typically includes a layer 104 of relatively stiff sponge, over which is formed a layer 106 of nitrilic rubber. Blanket 102 is typically produced by removing the fabric layer from a three-ply Vulcan 714 offset printing blanket commercially available from Reeves Brothers, Inc.

Over printing blanket 102 there is provided a 2–3 micron thick layer 108 of nitrocellulose loaded with carbon black to provide a conductive layer for the high voltage applied to the intermediate transfer member. This layer has an end to end resistance of about 20–30 kohm, but since the current drawn to the drum is only 50–100 microamperes, the voltage drop on the layer is less than 3 volts out of the applied voltage of 500–600 volts.

An outer layer 110 typically comprises a 2–3 micron thick layer of silicone rubber, such as Syl-Off 294, which acts as a release layer.

An alternative preferred embodiment of a blanket 114 in accordance with the invention is shown conceptually in cross section in FIG. 3C. In this embodiment the lowest level of the blanket is a Kapton layer 116, typically 100 microns thick, which is similar to layer 96 of FIG. 3B. The next layer is a sponge layer 118, functionally similar to sponge layer 98 shown in FIG. 3B and typically 300 microns thick.

Situated above layer 118, is a heater 120, with typical thickness 650 microns, whose structure and manufacture will be described later. An acrylic rubber layer 122 is formed onto the heater 120 and preferably penetrates therein. A conducting layer 124 and a release layer 126 complete the blanket. Additional spacer material 128, typically of Kapton may be added below the blanket, if additional blanket thickness is required. Alternatively the Kapton layer 116 may be thicker than the indicated thickness.

As is shown in FIGS. 3D and 3E, heater 120 may be formed by weaving heater wire 130 forming the woof and twisted thread 132 as the warp. In a typical application for forming a blanket with a 30 cm. axial dimension (when wrapped on drum 80) and a 41 cm circumferential dimension, wire 130 is formed of a 300 micron diameter copper core with a 10 micron lacquer coating, for a total diameter of 320 microns. Thread 132 is preferably of twisted Nomex thread with a nominal diameter of 320 microns. When wire 130 and thread 132 are formed into heater 120, the overall heater thickness and the center to center spacing of the wires are each approximately 650 microns.

Two connection wires 134 for energizing the heater are extensions of the heater wires 130. A Nomex cloth extension 136 is provided beyond each end of the heater portion of the heater 120.

The unconventional structure of the blanket heater 120 of FIGS. 3D and 3E enables its placement over sponge layer 118. It will be noted that heater 92 of the embodiment illustrated in FIG. 3B is placed below the sponge layer 98. Since heater 92 is stiff in both the circumferential and the axial directions, placement of the heater 92 above the sponge layer would substantially shield the blanket-photoconductor and blanket-final substrate image transfer interfaces from the compression properties of the sponge assembly 94.

Heater 120 on the other hand is stiff in the axial direction, but it is pliable in the circumferential direction and thus transmits the pressure at the respective interfaces to the sponge layer. Placing the heater closer to the transfer surface allows for a lower heater temperature for the same surface temperature, and allows for the sponge layer to be much cooler. The pressure along lines in the axial direction is substantially constant compared to the variations in the circumferential direction; it would be perfectly constant were the transfer surfaces perfect and the mechanical tolerances were equal to zero, the tolerances and imperfections cause some small variation in deformation and hence of pressure along the axial lines.

Figure 3F:
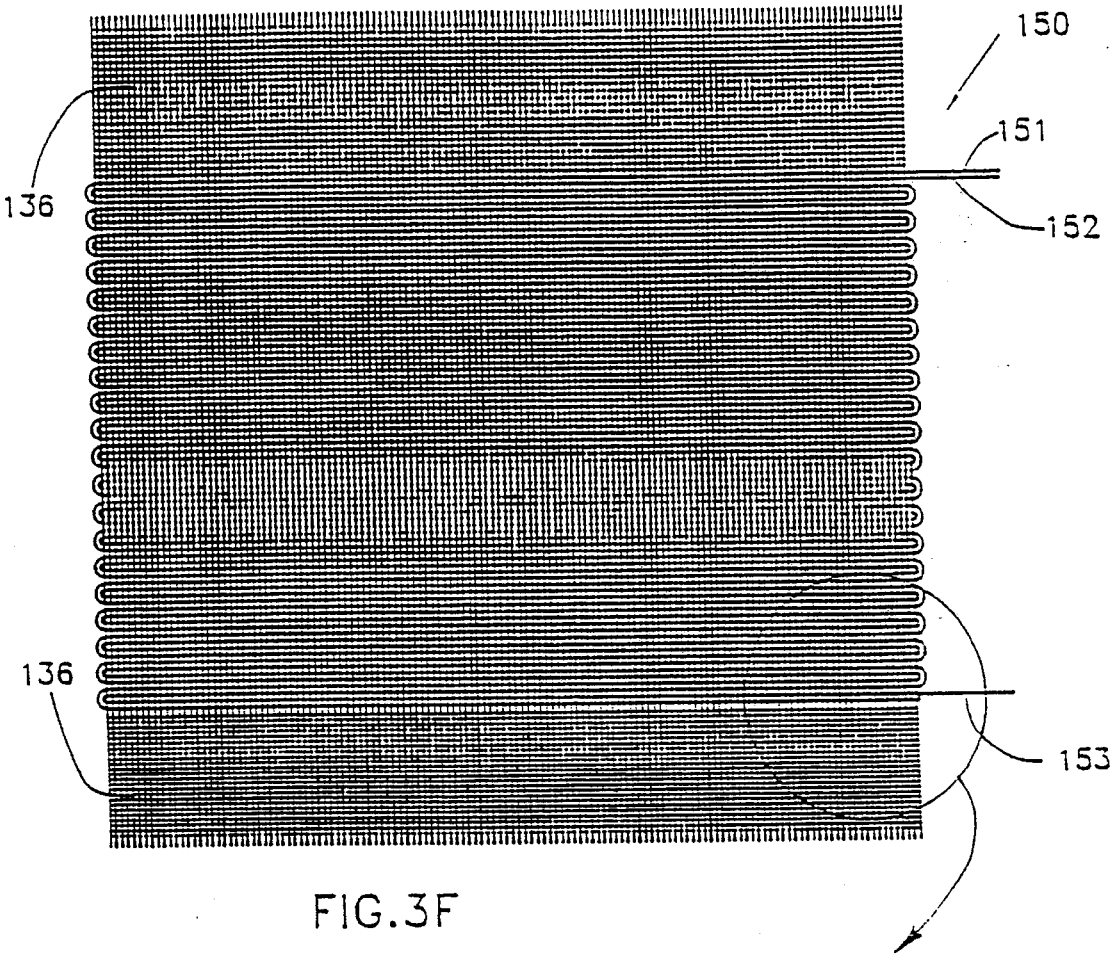
FIG. 3F is an illustration of another preferred heater for the intermediate transfer member.
Figure 3G:
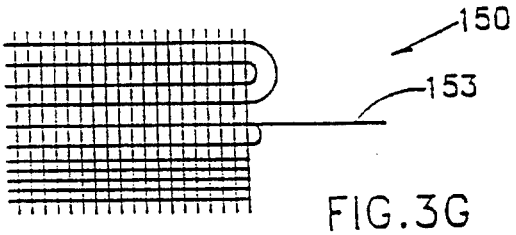
FIG. 3G is a detailed illustration of a portion of the embodiment of FIG. 3F.

An alternative preferred heater 150 is shown in FIGS. 3F and 3G. In this embodiment two inputs 151 and 152 are at the same end of the heater wires are threaded in a paired spaced relationship as shown in FIGS. 3F and 3G. Additional input 153 is electrically connected to the other end of the heater such that the current path between inputs 151 and 153 is substantially the same length as that between inputs 152 and 153.

Figure 6:
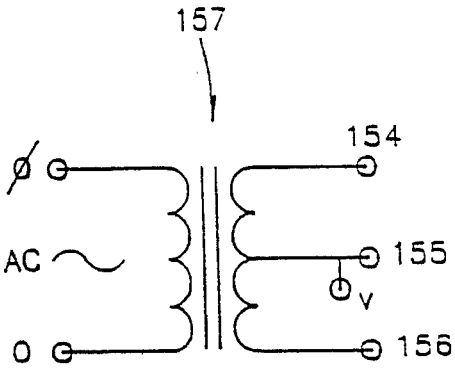
FIG. 6 is a schematic illustration of a preferred electrical circuit for energizing the heater embodiments of FIGS. 3F–3I.

The heater 150 is preferably energized with the circuit of FIG. 6, wherein the input to a transformer 157 is an AC voltage and a pair of output terminals 154 and 156 of transformer 157 are at the same voltage and at opposite phases with respect to a third terminal 155. Terminals 154, 155 and 156 are electrically insulated from the AC input.

Figure 3H:
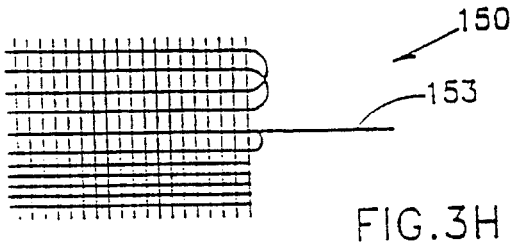
FIG. 3H is a detailed illustration of a portion of an alternative of of FIG. 3F.

In operation, heater 150 is incorporated in a blanket, and installed in the apparatus of FIG. 1. Terminals 154 and 156 electrically connected to inputs 151 and 152, and additional input 153 connected to terminal 155. Alternatively the wires can be "crossed" at each reversal of the wire direction (at the edges of the heater). One such crossing is shown in FIG. 3H.

Alternatively, wire 153 and terminal 155 could be externally electrically connected to the bias layer 124. Alternatively wire 153 and terminal 153 could be connected to a source of high voltage in order to provide a field at the transfer regions and layer 124 could be omitted. For this last alternative, a substantially higher voltage would be required to provide the field due to the greater distance of the heater from the transfer surface.

Figure 3I:
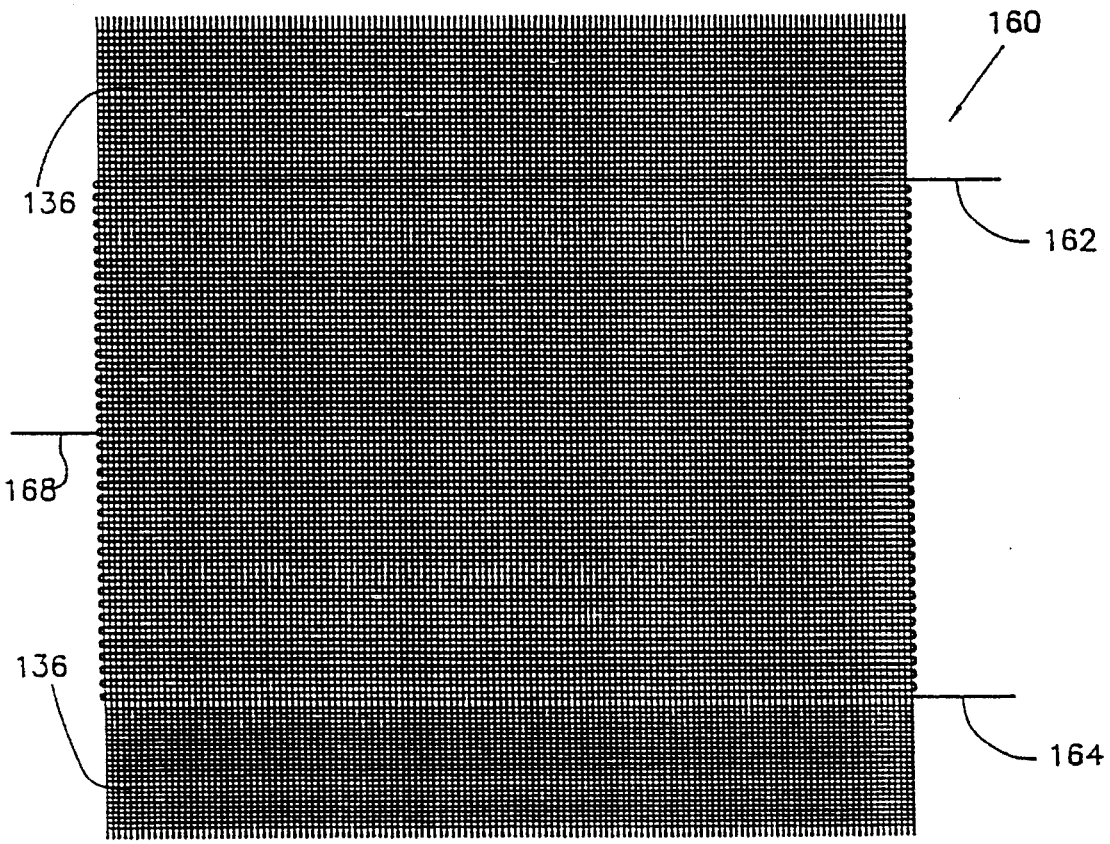
FIG. 3I is an illustration of another preferred heater for the intermediate transfer member.

An alternative preferred heater 160 is shown in FIG. 3I. In this embodiment the wire and thread are woven in a similar manner to that of the embodiment shown in FIG. 3D. Two connection wires 162 and 164 for energizing the heater are extensions of the heater wire and an additional wire 168 is electrically connected to the center of the length of wire used to form the heater. In operation the heater is energized by connecting wires 162 and 164 to terminals 154 and 156, and connecting wire 168 to terminal 155.

Alternatively, wire 168 and terminal 155 could be externally electrically connected to the bias layer 124.

Layer 122 should preferably have the following properties:

a) High Electrical resistivity at the operating temperature;

b) High resilience, especially at the second transfer (to the receiving substrate 42), due to the high pressures and deformation at that transfer;

c) The proper hardness—Approximately 40 Shore A;

d) It should be castable and bondable to subsequent layers;

e) It should have high strength, especially in tension and tear; and f) It should be stable under temperature and pressure, that is to say, its pressure-deformation curve should remain relatively stable after repeated compression and release at the temperature of operation.

Blanket 114 is preferably manufactured using the following process, although other manufacturing methods may suggest themselves to those knowledgeable in the art:

STEP I—Forming of layer 122 onto heater 120

100 parts by weight of HYTEMP 4051 Acrylic rubber compound manufactured by B. F. Goodrich is mixed in a two roll mill with 15 parts of very fine silica, 4 parts sodium stearate and 2 parts NPC-50 crosslinker, until the mixture is smooth. The silica is added to increase the electrical resistivity, mechanical cohesiveness and strength of the final polymer. A heater 120 is placed in a mold coated with silicone oil, and is covered with the rubber/silica mixture. The mixture is cured in the mold to a final thickness of 1500 microns at a temperature of 180° C. for 15 minutes. The mold is cooled and resulting sheet is removed. It will be appreciated that this sheet comprises heater 120 and rubber layer 122 formed into an integral unit due to the filling of the heater by the rubber/silica mixture before curing.

STEP II—Forming of the sponge layer 118

The procedure described above for the manufacture of the sponge assembly 94 (described in conjunction with FIG. 3B) is followed for this step, with the exception that the fabric layer 100 of that procedure is replaced by the double layer 120 and 122 produced by Step I, immediately above. The spacing of the rollers, and the thickness of the sizing jig are adjusted to account for the increased thickness of the new material.

In an alternative and preferred embodiment of the invention, the following procedure is followed:

100 parts by weight of HYTEMP 4051 Acrylic rubber compound manufactured by B. F. Goodrich is mixed in a two roll mill with 15 parts of very fine silica, 4 parts of sodium stearate, 2 parts of NPC-50 crosslinker and 11 to 33 parts by weight of Blowing Agent (#9038 Rhone Poulenc) until the mixture is smooth. The silica is added to increase the cohesiveness of the sponge. 1 part of the mixture is mixed with preferably 2 parts of a solvent, preferably acetone or MEK, in order to reduce its viscosity.

The blended material is calendered between the double layer 120 and 122 and the Kapton layer 116 essentially as described above and illustrated in FIG. 4, for the manufacture of sponge layer 98.

The total thickness of the resulting multilayer sheet 118, 122, 120 and 116 after calendering will depend on the amount of blowing agent used and can be found by simple experiment.

The triple layer is cured, preferably in a jig to control the total swelling thereof, at a temperature of 180° C. for 15 minutes. The mold is cooled and resulting sheet is removed. It will be appreciated that this sheet comprises all four layers formed into an integral unit. In an alternative embodiment of the invention Kapton layer 116 can be replaced by Nomex cloth, since the acrylic rubber layers together with the Nomex cloth appear to give sufficient structural strength to the blanket.

STEP III—Adding the conducting (bias) layer 124

15 parts of HYTEMP 4051, 100 parts of MEK (methylmetacrilate), 6 parts of carbon black (Printex XE-2 manufactured by Degussa) and 2 parts of NPC-50 cross-linker are mixed in a cooled ball attritor for 12 hours. This material is wire coated onto the surface of layer 122 and cured at 150° C. for 15 minutes to form an approximately 2 micron thick conducting layer with a resistance of between 10–100 kohm/square, preferably 30–50 kohm/square, bonded to layer 122.

STEP IV—Post Curing

Post curing of the HYTEMP 4051 is not part of the process as recommended by the manufacturer. It has been found that the stability of the material under compression cycling at operating temperature was improved by the addition of a 180 degree C, 12 hour post curing step.

STEP V—Adding the silicone release layer 126

100 parts of Syl-off 294 is diluted 1:1 with Isopar L. 15 parts of Syl-off 297 ancorning agent and 5 parts of Dow Corning 176 cross-linker are added to the mixture. This mixture is wire coated on to the surface of conducting layer 124 and air cured at 110° C. for 10 minutes to give 5–6 micron thick layer.

Figure 5:
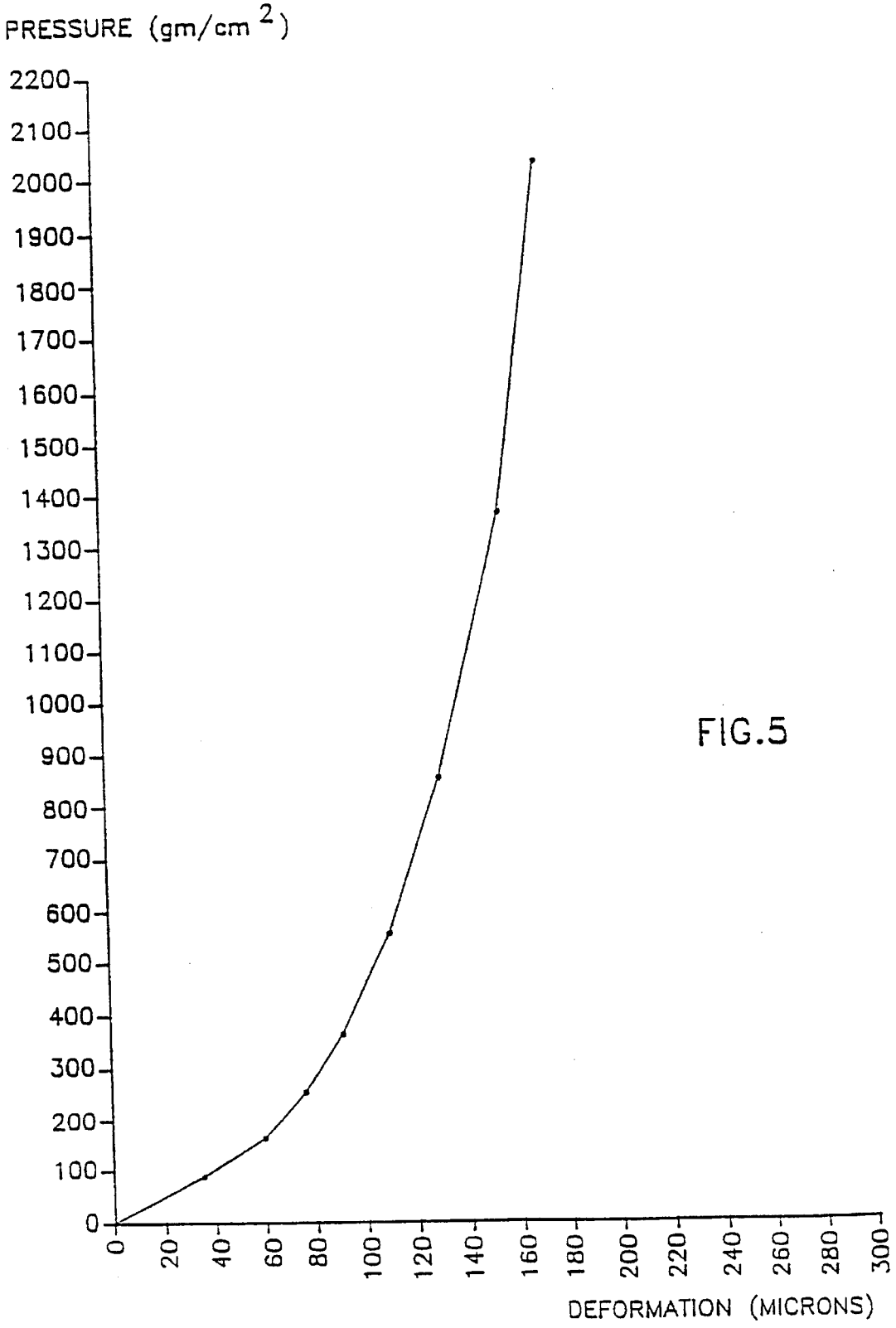
FIG. 5 is a graphical illustration of the relationship between pressure and deformation of the apparatus of FIG. 3B.

FIG. 5 is a graph which illustrates the approximate desired pressure/deformation characteristics of the intermediate transfer member structures shown in FIGS. 3B–3I, under ordinary use conditions in intermediate transfer apparatus according to a preferred embodiment of the present invention.

The invention is illustrated herein with examples employing a single developer station. The invention is especially useful in imaging systems with a multiple of development stations preferably with different color liquid developers, or a single station in which the liquid developer is changed between colors. For either of these systems each individual color image may be transferred to the final substrate from the ITM individually, or the colored images may be transferred sequentially to the ITM and then transferred to the substrate together. Color imaging equipment is described in U.S. Pat. Nos. 4,788,572; 4,690,539 and 3,900,003.

It will be appreciated by persons skilled in the art that the present invention is not limited by what has been particularly shown and described hereinabove. Rather the scope of the present invention is defined only by the claims which follow:

We claim:

1. Imaging apparatus comprising:

an image bearing surface having a toner image formed thereon; and a drum type intermediate transfer member having a transfer surface which receives the toner image from the image bearing surface and subsequently transfers the image to a substrate, wherein the intermediate transfer drum comprises a rigid core and an intermediate transfer blanket which is fixedly and replaceably secured and attached to the core.

2. Apparatus according to claim 1 wherein the intermediate transfer member also comprises grippers for fixedly securing the blanket on the core whereby the blanket is fixedly and replaceably secured and attached to the core.

3. Apparatus according to claim 1 wherein said imaging apparatus also comprises:

means for providing first transfer engagement between said intermediate transfer blanket and said image bearing surface for transfer of a liquid toner image from said image bearing surface to said intermediate transfer blanket at a first pressure, producing deformation of the intermediate transfer member to a first deformation degree; and means for providing second transfer engagement between said intermediate transfer blanket and said substrate for transfer of said liquid toner image from said intermediate transfer member to said substrate at a second pressure, producing deformation of the intermediate transfer member to a second deformation degree.

4. Apparatus according to claim 3 wherein the second pressure exceeds the first pressure by a first multiple and the second deformation degree exceeds the first deformation degree by a second multiple, substantially less than said first multiple.

5. Apparatus according to claim 1 and wherein the intermediate transfer member comprises a heater operative to heat the liquid toner image thereon prior to said second transfer engagement.

6. Apparatus according to claim 3 and wherein the intermediate transfer member comprises a heater operative to heat the liquid toner image thereon prior to said second transfer engagement.

7. Apparatus according to claim 4 and wherein the intermediate transfer member comprises a heater operative to heat the liquid toner image thereon prior to said second transfer engagement.

8. Apparatus according to claim 7 and wherein the heater is operative to heat said liquid toner image to a temperature sufficient to enhance transfer of said liquid toner image from said intermediate transfer member to said substrate.

9. Apparatus according to claim 4 and wherein the heater is operative to heat said liquid toner image to a temperature sufficient to enhance transfer of said liquid toner image from said intermediate transfer member to said substrate.

10. Apparatus according to claim 9 wherein the heater is a blanket heater comprised in said intermediate transfer blanket.

11. Apparatus according to claim 10 wherein said first and second pressures are substantially constant along particular lines upon said first and second transfer engagements on said intermediate transfer member, and wherein said heater is formed of thin wires along said lines.

12. Apparatus according to claim 1, wherein said intermediate transfer blanket comprises:

an outward facing transfer surface;

a compressible layer;

a backing layer; and a heating layer, said heating layer being disposed intermediate said backing layer and said transfer surface.

13. Apparatus according to claim 12 and also comprising a resilient layer, said heating layer being disposed intermediate said compressible layer and said resilient layer.

14. Apparatus according to claim 12 and wherein said heating layer is disposed intermediate said backing layer and said compressible layer.

15. Apparatus according to claim 12 and wherein said heating layer is disposed intermediate said transfer surface and said compressible layer.

16. Apparatus according to claim 12 wherein only resilient materials are placed between said heater layer and said transfer surface.

17. Apparatus according to claim 1, wherein said intermediate transfer blanket comprises:

at least one resilient layer; and a backing layer disposed away from said image bearing surface, wherein said at least one resilient layer includes a heating layer.

18. Apparatus according to claim 1 and wherein said intermediate transfer blanket comprises first and second resilient layers having different stiffnesses.

19. Apparatus according to claim 11 and also including a heater power supply which applies a heater voltage to the blanket heater whereby the blanket is heated.

20. Apparatus according to claim 19 and also including a power supply which supplies a second voltage between the blanket heater and the drum to improve transfer of the toner images from the image bearing surface to the intermediate transfer member.

21. Apparatus according to claim 19 wherein the heater voltage is an alternating current voltage and the thin wires are arranged in adjoining pairs, the heater voltage on each wire of the pair being equal and of opposite sign to that of the other with respect to the second voltage.

22. Apparatus according to claim 1, wherein the toner image is a liquid toner image.

* * * * *